US006299465B1

(12) United States Patent
Hirata

(10) Patent No.: US 6,299,465 B1
(45) Date of Patent: Oct. 9, 2001

(54) CONNECTOR ASSEMBLY WITH EJECTOR

(75) Inventor: Toshihisa Hirata, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/665,864

(22) Filed: Sep. 20, 2000

(30) Foreign Application Priority Data

Sep. 20, 1999 (JP) ..... 11-265397

(51) Int. Cl.[7] ..... H01R 13/62
(52) U.S. Cl. ..... 439/159
(58) Field of Search ..... 439/155, 159, 439/160, 260, 157, 377; 361/754, 798

(56) References Cited

U.S. PATENT DOCUMENTS 4,466,680 * 8/1984 Sakai et al. ..... 439/159
6,089,895 * 7/2000 Hashiguchi et al. ..... 439/260

* cited by examiner

*Primary Examiner*—Brian Sircus
*Assistant Examiner*—Son V. Nguyen
(74) *Attorney, Agent, or Firm*—Stacey E. Caldwell

(57) ABSTRACT

Disclosed is a connector assembly (1) for receiving a card medium (60) having card contacts (61) on a front edge thereof. The connector assembly comprises a header (20) having terminals (24) for electrically connecting to the card contacts of the card medium and an ejector unit (40) for ejecting the card from the header. The ejector unit (40) comprises a spring-biased actuator (41) for applying an ejecting force to the card, and a latching mechanism having at least one rotary piece (47) rotatably fixed to the actuator with notches (48) and contours (49) formed on opposite ends thereof, and stationary cam projections (50, 51) spaced from each other to allow the rotary piece (47) to move from one to the other cam projection, such that each cam projection follows the notches (48) and contours (49) of one end of the rotary piece, thereby causing the rotary piece to turn and lock the actuator when one of the cam projections catches one end of the rotary piece.

12 Claims, 5 Drawing Sheets

CONNECTOR ASSEMBLY WITH EJECTOR

FIELD OF THE INVENTION

The present invention relates generally to the art of electrical connectors and particularly to a connector assembly which permits a card device, such as a PCMCIA card, compact flash card or other card medium to be connected to an associated printed circuit.

BACKGROUND OF THE INVENTION

Known card connector assemblies are designed to receive cards having a plurality of contacts arranged on a front edge thereof, and the terminals of the connector assembly, which are soldered to corresponding conductors of an underlying printed circuit board, are electrically connected to the contacts of the card, thereby making an electrical connection between the card and the printed circuit board. The connector assembly typically comprises a header having a plurality of terminals corresponding to the contacts of the card and an ejector unit for ejecting the card from the header. Known ejector units use a heart-shaped cam and a cam follower in the form of rod, which projects from the actuator such that rotation of the heart-shaped cam causes the actuator to move through the agency of the rod projection in a controlled fashion.

Such an ejector unit is complex in structure, uses many component parts and is therefore relatively costly. Furthermore, the component parts function in a friction-type of operation and therefore are liable to be worn, causing the undesirable production of debris.

SUMMARY OF THE INVENTION

One object of the present invention is to provide a connector assembly which is relatively simple in structure and does not operate by way of friction, thereby minimizing any defects produced from friction-operating parts.

To attain this object, a connector assembly is provided for receiving a memory card or other plate-like medium having a plurality of contacts arranged on a front edge thereof. The card assembly comprises a header having a plurality of terminals for making electrical connections with the contacts of the card, and an ejector unit for ejecting the card from the header. The ejector unit comprises: a spring-biased actuator including a spring responsive to insertion of the card into the header for applying an ejecting force to the card; and a latching mechanism comprising an elongated notched rotary piece rotatably fixed to the actuator and having notches on opposite ends and stationary cam and contour projections confronting each other to allow the rotary piece to move from one to the other cam projection, permitting each cam projection to follow the notched and contour sections of one end of the rotary piece, thereby allowing the rotary piece to turn and lock the actuator when one of the cam projections catches one end of the rotary piece.

The connector assembly is simple in structure and does not use frictional parts, therefore avoiding the production of debris.

The ejector unit may further comprise means for resiliently urging the rotary piece against the actuator.

The ejector unit may further comprise clicking means for audible indication responsive to movement of the rotary piece to selected angular positions.

The ejector unit may be integrally connected to the header.

The ejector unit may have two or more sets of rotary piece and cam projections.

Other objects and advantages of the present invention will be understood from the following description of a connector assembly according to preferred embodiments of the present invention, which are shown in accompanying drawings.

BRIEF DESCRIPTION OF THE DRAWINGS

The features of the invention which are believed to be novel are set forth with particularity in the appended claims. The invention, together with its objects and the advantages thereof, may be best understood by reference to the following description taken in conjunction with the accompanying drawings, in which like reference numeral identify like elements in the figures and in which:

DESCRIPTION OF PREFERRED EMBODIMENT

Figure 1:
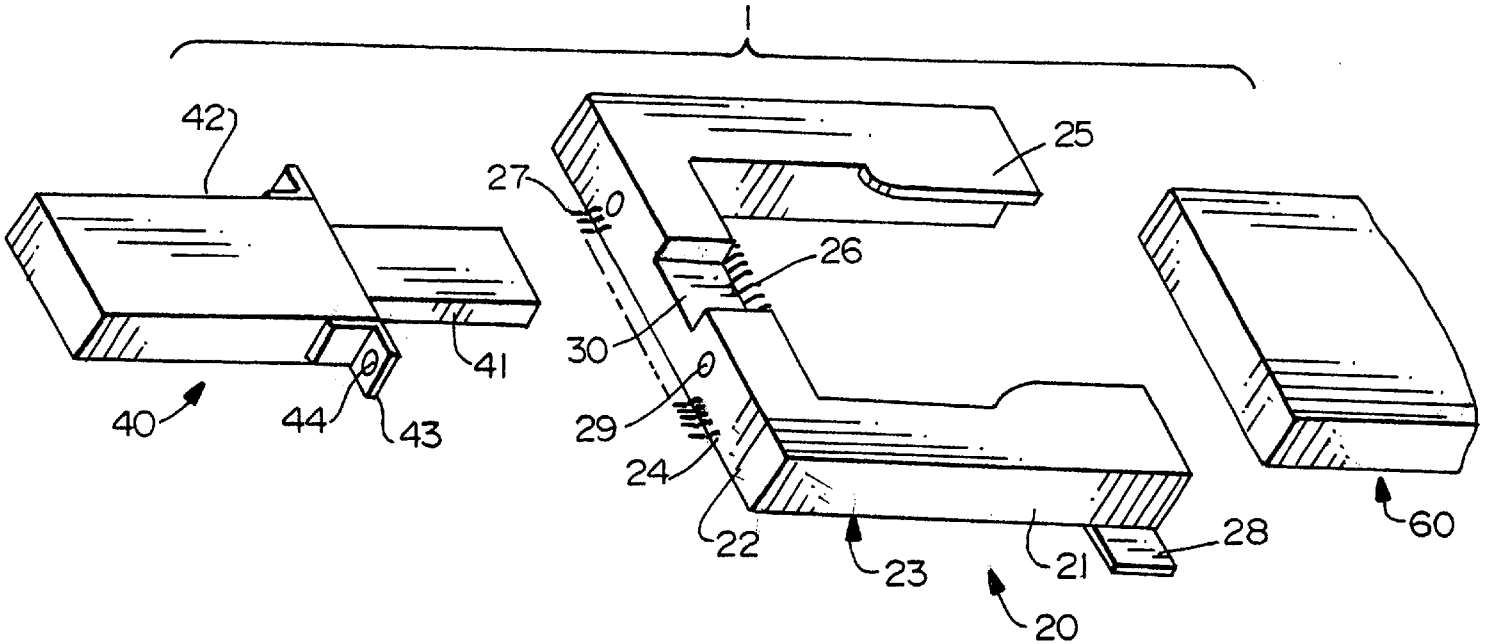
FIG. 1 is an exploded perspective view of a connector assembly according to one embodiment of the present invention.
Figure 2:
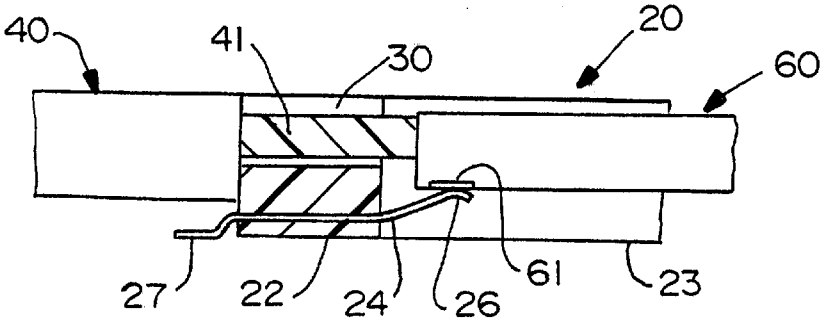
FIG. 2 is a sectional view of a portion of the connector assembly.

FIG. 1 shows a connector assembly 1 for receiving an electronic memory card or other plate-like medium 60 (hereinafter "card"), which card has a plurality of card contacts 61 arranged a front edge thereof. The connector assembly 1 comprises a header 20 having a corresponding plurality of terminals 24 to make contact with the card contacts of the card and an ejector unit 40 for ejecting the card from header 20. Header 20 includes a "U"-shaped insulating housing 23, which is composed of a lateral section 22 and two opposite longitudinal sections 21 integrally connected to opposite ends of lateral section 22. Lateral section 22 includes terminals 24 arranged at regular intervals and mounted therein, as shown in FIG. 2.

Opposite longitudinal sections 21 are spaced from each other a distance approximately equal to the width of card 60, thus serving to guide card 60 during insertion into header 20. Still referring to FIG. 1, longitudinal sections 21 have an inward projection 25 integrally connected to an upper rear end thereof. Referring to FIG. 2, each terminal 24 has a contact end 26 formed on one end and a solder tail 27 formed on the other end. Contact end 26 of terminal 24 contacts a corresponding card contact 61 on the front edge of card 60. The intermediate section of each terminal is embedded in lateral section 22 of housing 23 by overmolding (shown) or stitching (not shown). As seen in FIG. 1, each longitudinal section 21 has a plate-like stay or fitting nail 28 fixed to a lower end thereof. The horizontal piece of fitting nail 28 is coplanar with solder tails 27 of terminals 24, permitting header 20 to be fixed to an underlying printed circuit board (not shown) by soldering the solder tails of the terminals to corresponding conductors of the printed circuit board.

Looking now to FIGS. 4 and 5, ejector unit 40 comprises a spring-biased actuator 41, and a latching mechanism including a notched rotary piece 47 and corresponding cam projections 50 and 51, as later described in more detail. Actuator 41 projects from box-like casing 42, and is responsive to insertion of card 60 into header 20 such that it applies a constant ejecting force to card 60 with the aid of a spring 45 positioned on the bottom of box-like casing 42. Casing 42 has "L"-shaped fastening metals 43 fixed to front opposite sides thereof. These fastening metals 43 have holes 44 made in their lateral flaps, and lateral section 22 of header 20 has counter tapped holes 29 on its front side. When casing 42 is positioned on the front side of lateral section 22 of header 20 with projecting actuator 41 slidably-fitted in a center notch 30 of lateral section 22, holes 44 of fastening metals 43 are in alignment with tapped holes 29 of lateral section 22, thus permitting ejector unit 40 to be integrally fastened to header 20 with screws (not shown). When ejector unit 40 is fixed to the front side of lateral section 22 of header 20, actuator 41 extends beyond lateral section 22, toward an inserted card 6.

Figure 3:
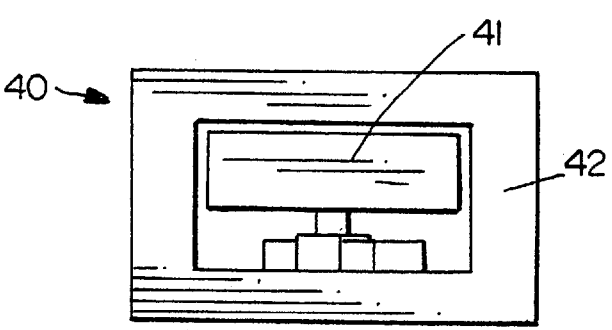
FIG. 3 is an enlarged front end view of the ejector unit of the connector assembly.
Figure 5:
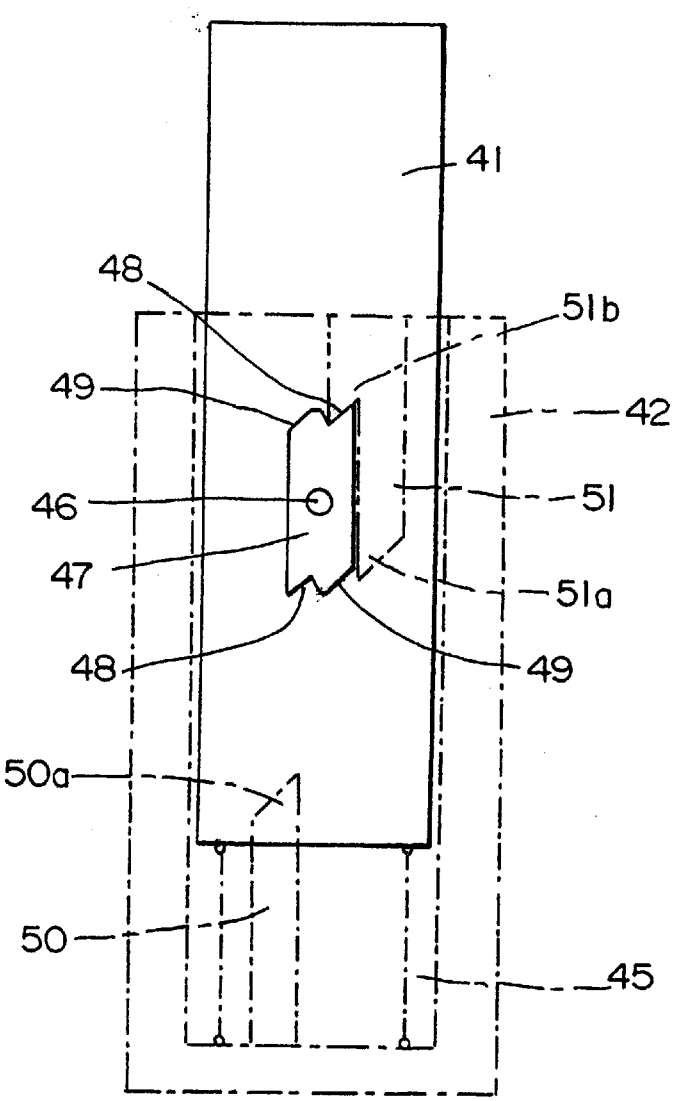
FIG. 5 is a plan view similar to FIG. 4, showing the casing in phantom lines.
Figure 4:
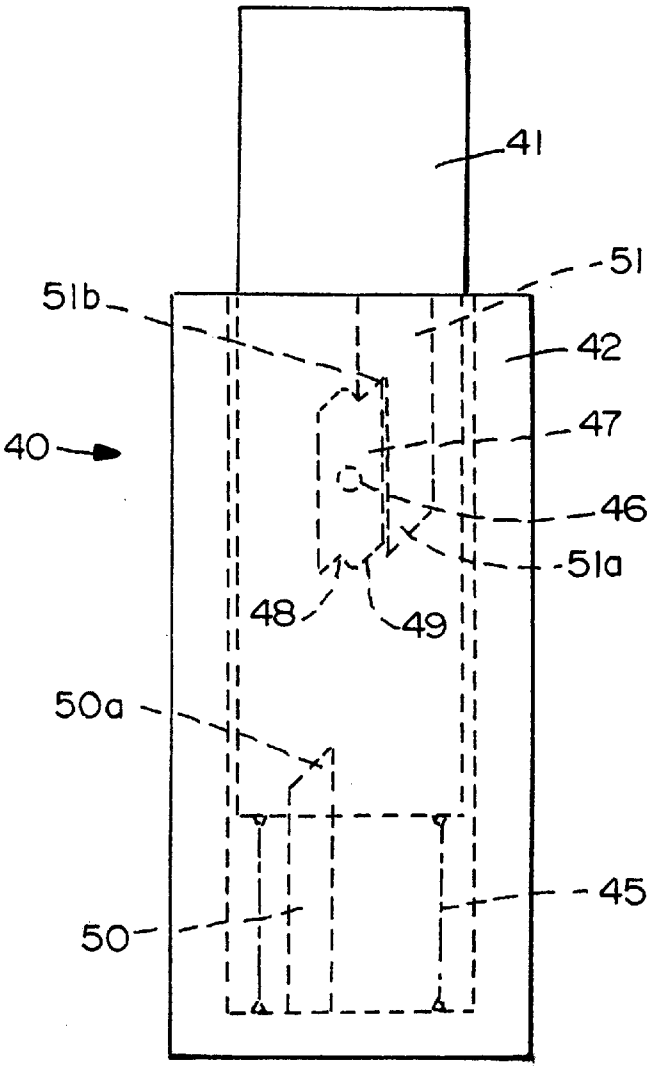
FIG. 4 is an enlarged plan view of the ejector unit.

Referring to FIGS. 3 to 5, actuator 41 has a notched rectangular rotary piece 47 rotatably fixed about a pivot stud 46 on an upper surface of actuator 41. Rotary piece 47 has notches 48 and slants 49 made on its opposite short sides. These notch-and-slant contours are symmetrical with respect to pivot stud 46.

Stationary cam projections 50 and 51 are fixed on an upper surface of casing 42 in longitudinally spaced from each other and in confronting relation with the notch-and-slant contours of the opposite short sides of rotary piece 47 when rotary piece 47 is in alignment with the longitudinal center axis of casing 42. One of the cam projections 51 is positioned close to the opening of casing 42, and the second cam projection 50 is positioned close to the bottom of casing 42. The second cam projection 50 has an inclined "V"-shaped end 50*a,* which is directed to rotary piece 47. The first cam projection 51 has two inclined "V"-shaped sections 51*a* and 51*b* staggered along its longitudinal axis. These inclined "V"-shaped sections 51*a* and 51*b* are also directed to rotary piece 47. Each inclined "V"-shape has an angle somewhat smaller than the corresponding "V"-shaped notch 48 of each short side or end of rotary piece 47.

Referring to FIGS. 6*a* through 6*j,* the function of the latching mechanism is described, i.e. the manner in which cam projections 50 and 51 catch, release and rotate rotary piece 47 for latching and unlatching actuator 41 is defined. Note that since rotary piece 47 is rotatably fixed to actuator 41, the movement by application or removal of force of actuator 41 causes similar movement of rotary piece 47, though rotary piece is also able to rotate about pivot stud 46.

Figure 6:
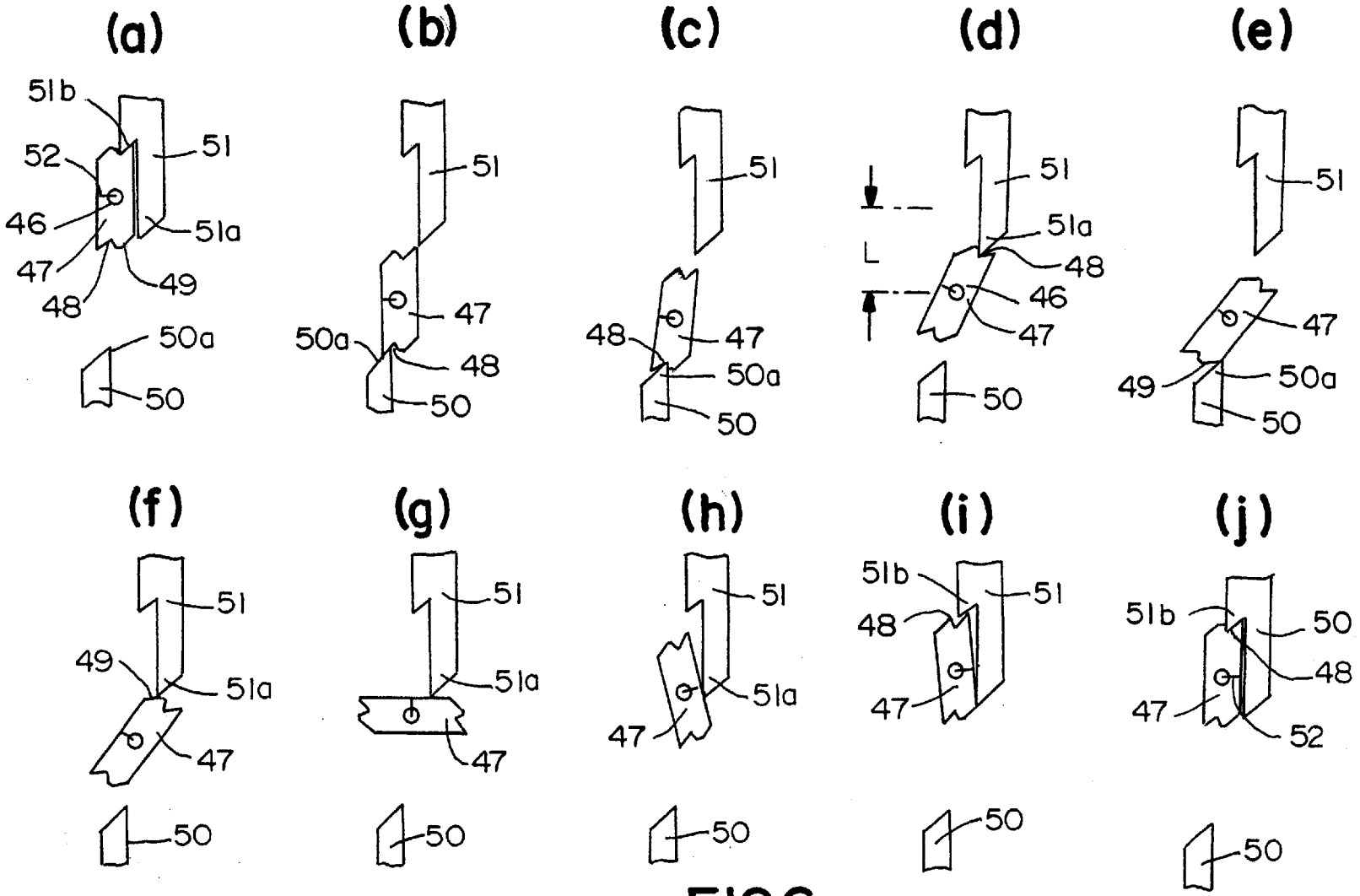
FIG. 6 illustrates how the ejector unit components function in response to the insertion of a card.

In an initial position shown in FIG. 6*a,* first notch 48 of rotary piece 47 is caught by"V"-shape 51*b,* allowing actuator 41 to extend a maximum distance from casing 42 while held in this position by the influence of spring 45. When actuator 41 is pushed into casing 42 by applying an external force to actuator 41, rotary piece 47 moves away from first cam projection 51, and moves toward second cam projection 50 (FIG. 6*b*). When second notch 48 of rotary piece 47 abuts "V"-shaped end 50*a* of second cam projection 50, rotary piece 47 turns slightly clockwise (FIG. 6*c*), and actuator 41 is caused to stop, projecting a minimum distance from casing 42. Actuator 41 is held in this position as long as the external pushing force is applied.

Cessation of the external pushing force applied to actuator 41 allows actuator 41 to move outward under the influence of spring 45 (FIG. 6*d*). Specifically, rotary piece 47 moves toward first cam projection 51 such that first "V"-shaped notch 48 of rotary piece 47 abuts "V"-shape 51*a* of first cam projection 51, thereby causing rotary piece 47 to turn slightly clockwise about pivot 46. In this latching position, actuator 41 is caused to stop (FIG. 6*d*) allowing actuator 41 to extend a distance slightly longer than the minimum distance from casing 42 (the minimum distance plus the backlash distance). Actuator 41 is held in this position, where actuator 41 is withdrawn a distance "L" apart from the initial position shown in FIG. 6*a*.

When force is again applied to actuator 41, i.e. actuator 41 is pushed into casing 42 from the position shown in FIG. 6*d,* rotary piece 47 moves toward second cam projection 50 in the state of being somewhat inclined, and therefore "V"-shaped end 50*a* of second cam projection 50 is in contact with one longitudinal side of rotary piece 47 without being caught by the "V"-shaped notch of the other short side or second end of rotary piece 47, thus causing rotary piece 47 to turn slightly clockwise. Cessation of the external pushing force applied to actuator 41 allows actuator 41 to project further from casing 42. FIGS. 6*f* through j show how rotary piece 47 and counter cam projection 51 cooperate and interengage after cessation of the external force.

Still referring to FIGS. 6*f* through 6*j,* the movement of actuator 41 causes rotary piece 47 to move once again toward first cam projection 51, allowing slant section 49 of the first notched end of rotary piece 47 to contact the "V"-shape 51*a* of first cam projection 51, thereby causing rotary piece 47 to turn slightly clockwise (FIG. 6*f*). Then, "V"-shape 51*a* of first cam projection 51 follows the other longitudinal side of rotary piece 47, thus causing rotary piece 47 to turn clockwise a greater distance (FIGS. 6*g* and 6*h*). Thus, the second notched end of rotary piece 47 confronts trailing "V" shape 51*b* of first cam projection 51 (FIG. 6*i*). Finally, "V"-notch 48 of the second notched end of rotary piece 47 is caught by trailing "V"-shape 51*b* of first cam projection 51 so that actuator 41 is prevented from advancing and projecting further from casing 42 (FIG. 6*j*).

Rotary piece 47 therefore rotates 180 degrees from the initial position shown in FIG. 6*a* to the final position shown in FIG. 6*j,* as is shown by reference mark 52 on rotary piece 47 (FIG. 6*a* and 6*j*). Actuator 41 follows sequential positions as shown in FIGS. 6*a* to 6*d,* advancing, withdrawing and advancing again in FIG. 6*d*. Every time actuator 41 advances and withdraws, rotary piece 47 turns 180 degrees.

When card 60 is inserted into header 20, actuator 41 moves from its projecting position 6*a* to its withdrawn position 6*d* by compressing spring 45, and actuator 41 is locked in its withdrawn position 6*d,* where card 60 is held with its card contacts 61 in contact with contact ends 26 of terminals 24.

When card 60 is inserted into header 20, rotary piece 47 follows sequential positions as shown in FIGS. 6*a* to 6*d* to latch the actuator in the position shown in FIG. 6*d*. When card 60 is pushed slightly toward ejector unit 40, rotary piece 47 moves as shown in FIGS. 6*e* through 6*j*, allowing actuator 41, urged continuously by spring 45, to push and eject card 60.

Although actuator 41 is described above as being rotatably attached to the actuator by stud pivot 46, as a matter of design choice, rotary piece 47 may have a pivot axle 46 integrally connected thereto, and actuator 41 may have a bearing hole at its center for accommodating pivot axle 46 of rotary piece 47.

A resilient force may be applied to rotary piece 47 in a direction parallel to its pivot to maintain its position with respect to actuator 41 and assuring that rotary piece 47 is prevented from turning except for rotation as a counter action to abutting either cam projection.

Figure 7:
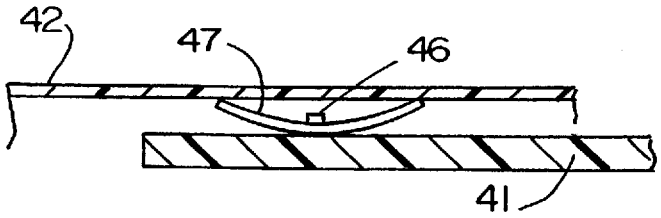
FIG. 7 illustrates the configuration of a rotary piece which provides a resilient force thereon.
Figure 8:
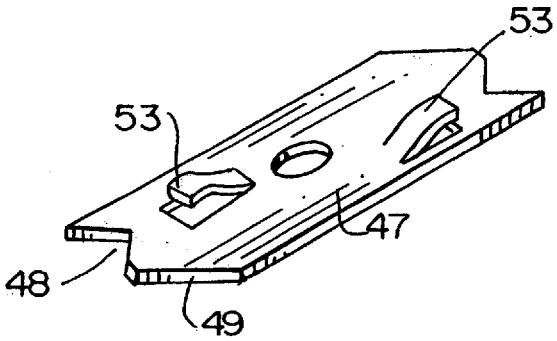
FIG. 8 is a perspective view of another example of a rotary piece, which has resilient fingers integrally formed thereon.
Figure 9:
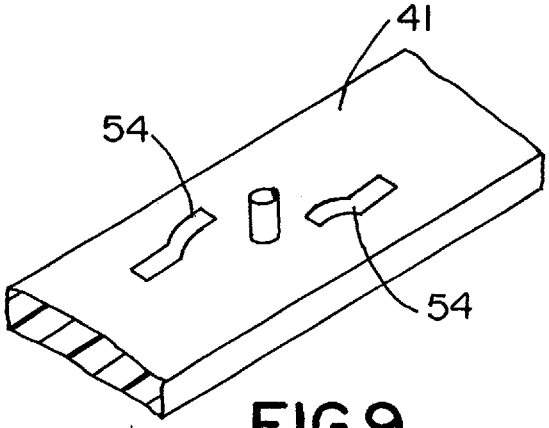
FIG. 9 is a perspective view of an actuator which has resilient members fixed thereto.

Rotary piece 47 can take on different forms in order to perform its function. Referring to FIG. 7, rotary piece 47 can be formed so that it exerts a resilient force against the upper surface of casing 42. FIG. 8 shows an example in which rotary piece 47 has integral resilient fingers 53 cut and formed from a surface thereof. FIG. 9 shows actuator 41 having separate resilient members 54 fixed to an upper surface of the actuator.

Figure 10:
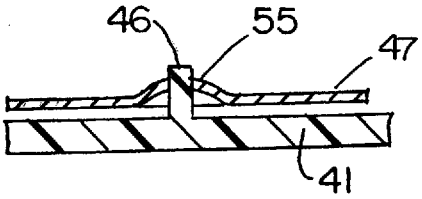
FIG. 10 is a perspective view of still another example of a rotary piece, which has a funnel-shaped aperture made therein.
Figure 11:
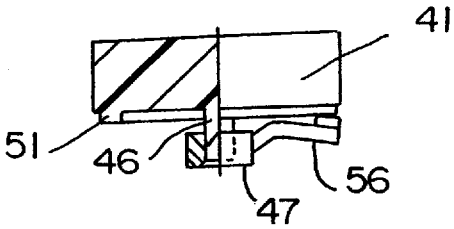
FIG. 11 is an enlarged sectional view of a portion of an embodiment of the actuator, which is provided with an audible click mechanism which clicks in response to the movement of the rotary piece to selected angular positions.
Figure 13:
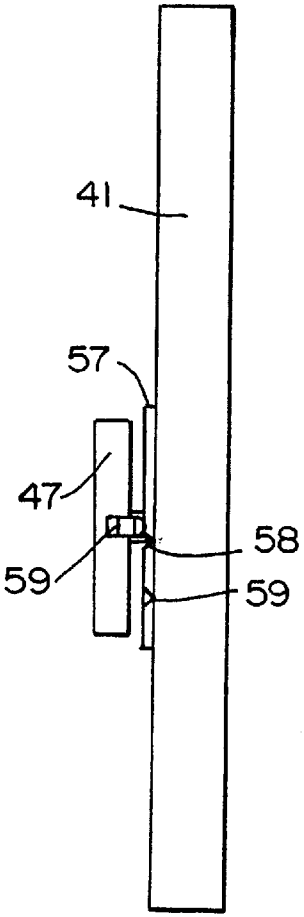
FIG. 13 is an enlarged side view of the actuator of FIG. 11.
Figure 12:
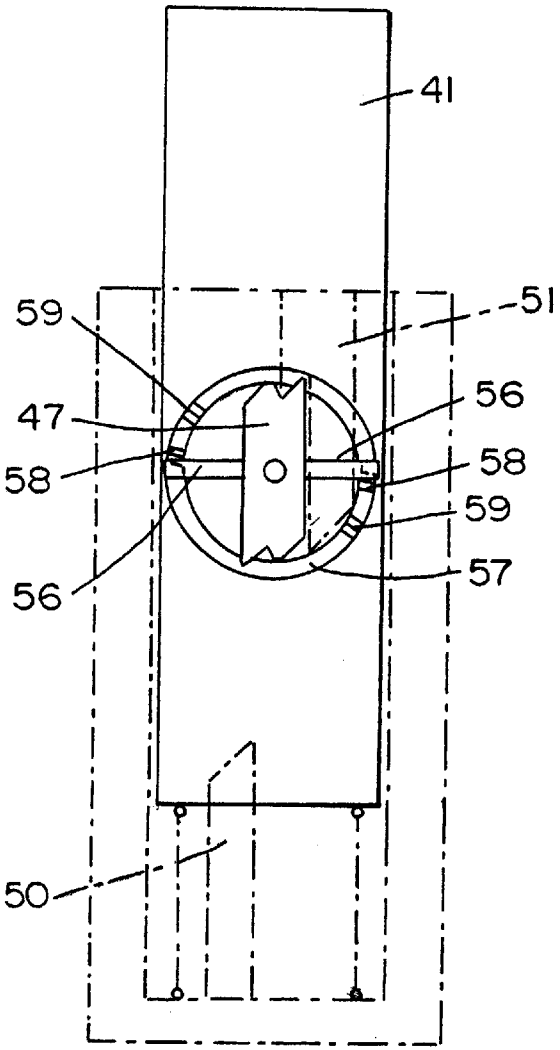
FIG. 12 is an enlarged plan view of the actuator of FIG. 11, showing the casing in phantom lines.

FIG. 10 shows rotary piece 47 having a funnel-like hole 55 formed therein. When stud pivot 46 of actuator 41 is inserted into hole 55 of rotary piece 47, rotary piece 47 exerts a resilient force against an inside upper surface of casing 42. Referring to FIGS. 11 through 13, rotary piece 47 may include two resilient arms 56 extending from opposite longitudinal sides, allowing their contact ends to slide on an annular projection 57 formed on an upper surface of actuator which has recesses 58 and 59 at selected angular positions. The selected angular positions correspond to the position of arms 56 when rotary piece 47 and counter cam projection 51 are in the position shown in FIG. 6*c* whereas recesses 58 and 59 are located at angular positions corresponding to the position of arms 56 when rotary piece 47 and counter cam projection 51 are in the position shown in FIG. 6*e*. Thus, when card 60 is inserted in casing 42, and when card 60 is ejected, the movement of resilient arms 56 into recesses 58 and 59 produces an audible "click".

Figure 14:
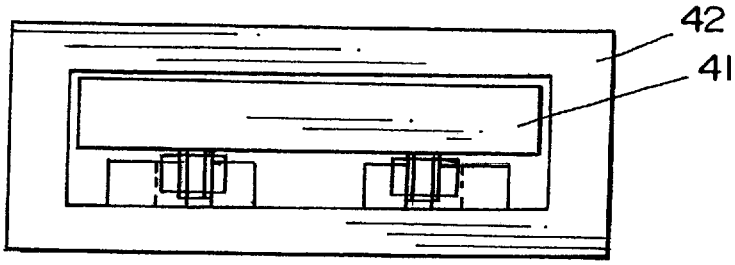
FIG. 14 is an enlarged end view of a connector assembly using two sets of rotary piece-and-cam projections arranged in parallel in the ejector unit.
Figure 15:
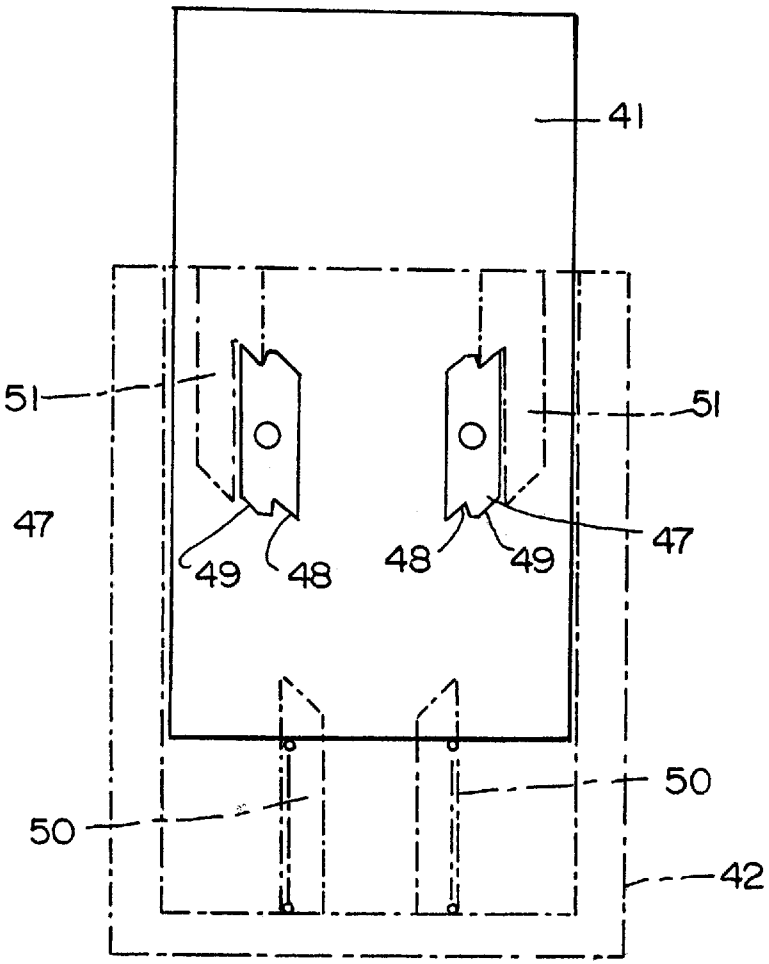
FIG. 15 is an enlarged plan view of the connector assembly of FIG. 14, showing the casing in phantom lines.

Referring to FIGS. 14 and 15, a connector assembly according another embodiment of the present invention uses a pair of rotary pieces 47. These rotary pieces 47 are arranged symmetrically with respect to the longitudinal centerline of the connector assembly, and are fixed to actuator 41. Two sets of cam projections 50 and 51 are arranged symmetrically with respect to the longitudinal centerline of the connector assembly, and are fixed to an upper inside surface of casing 42, and correspond to the tow rotary pieces 47. In some applications, the use of two such rotary pieces and cam projections can be advantageous.

Ejector unit 40 has been described as being fixed directly to header 20. Ejector unit 40 may also be bolted to a stationary board which is fixed to header 20. Regardless of the configuration, ejector unit 40 and header 20 are separate parts, permitting substitution or replacement by new parts when necessary. Furthermore, these parts can be standardized.

Based upon the foregoing description, it is apparent that the connector assembly of the invention is simple in structure. Furthermore, with the latching mechanism being constructed as described, the number of component parts required for the connector assembly is minimized. The connector assembly has no frictional parts other than cam projections 50 and 51 and rotary piece 47, causing little or no debris during functioning.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A connector assembly for receiving a card having a plurality of card contacts on a front edge thereof comprising:

a header having a plurality of terminals for electrically connecting to the card contacts, and an ejector unit for ejecting the card from the header, including a casing for housing the ejector unit, a spring-biased actuator slidably mounted within the casing and including a spring positioned on the bottom of the casing for applying an ejecting force to the card, and a latching mechanism having a notched rotary piece rotatably fixed to the actuator and having a notch and a slant formed on each opposite end of the notched rotary piece; and two stationary cam projections fixed to opposing ends of the casing and spaced from each other in a longitudinal direction parallel to an insertion direction of the card to allow the rotary piece to move from one to the other cam projection, wherein each cam projection has one end having a configuration which corresponds in shape to the notch and slant at each end of the rotary piece such that the rotary piece can turn and lock the actuator in a position when one of the cam projections catches one end of the rotary piece in response to the application or removal of the ejecting force.

2. The connector assembly according to claim 1 wherein the notched rotary piece is rectangular in shape and the notch and slant are formed on opposite short sides of the rotary piece.

3. The connector assembly according to claim 1 wherein each of the cam projections has an inclined "V"-shaped end corresponding to the notch and slant of the rotary piece.

4. The connector assembly according to claim 3 wherein one of the cam projections includes two "V"-shaped sections in the configuration at the one end and the other of the cam projcetions includes one "V"-shaped section in the configuration at the one end.

5. The connector assembly according to claim 1 wherein the ejector unit further comprises means for resiliently urging the rotary piece against the actuator.

6. The connector assembly according to claim 5 wherein the means for resiliently urging the rotary piece against the actuator comprises resilient fingers integrally formed on a surface of the rotary piece.

7. The connector assembly according to claim 5 wherein the means for resiliently urging the rotary piece against the actuator comprises resilient members fixed to a surface of the actuator.

8. The connector assembly according to claim 1 wherein the ejector unit further comprises means for indicating an audible response to movement of the rotary piece to selected angular positions.

9. The connector assembly according to claim 8 wherein the means for indicating an audible response to movement of the rotary piece comprises resilient arms extending from longitudinal sides of the rotary piece and an annular projection within which the resilient arms slide.

10. The connector assembly according to claim 9 wherein the annular projection includes recesses which correspond to certain positions of the resilient arms, wherein the certain positions indicate insertion of the card and ejection of the card.

11. The connector assembly according to claim 1 wherein the ejector unit has two sets of latching mechanisms.

12. The connector assembly according to claim 11 wherein the two sets of latching mechanisms comprise a pair of rotary pieces rotatably fixed to the actuator and arranged symmetrically with respect to a centerline of the connector assembly extending in the longitudinal direction, and two sets of cam projections fixed to an inside upper surface of the ejected unit and also arranged symmetrically with respect to the centerline of the connector assembly.

* * * * *